US006190131B1

(12) United States Patent
Deallenbach

(10) Patent No.: US 6,190,131 B1
(45) Date of Patent: Feb. 20, 2001

(54) NON-INTEGRAL BALANCED COVERPLATE AND COVERPLATE CENTERING SLOT FOR A TURBINE

(75) Inventor: Robert Edward Deallenbach, Schenectady, NY (US)

(73) Assignee: General Electric Co., Schenectady, NY (US)

( * ) Notice: Under 35 U.S.C. 154(b), the term of this patent shall be extended for 0 days.

(21) Appl. No.: 09/386,843

(22) Filed: Aug. 31, 1999

(51) Int. Cl.[7] ..... F01D 25/00; F01D 5/00

(52) U.S. Cl. ..... 416/144; 416/221; 416/193 A; 416/220 R

(58) Field of Search ..... 416/144, 145, 416/219 R, 220 R, 221, 193 A, 248, 500

(56) References Cited

U.S. PATENT DOCUMENTS 2,801,074 * 7/1957 Brown ..... 416/221
2,916,257 * 12/1959 Poellmitz et al. ..... 416/500
3,076,634 * 2/1963 Boyle et al. ..... 416/221
3,297,302 * 1/1967 Spears, Jr. ..... 416/144
3,814,539 * 6/1974 Klompas ..... 416/220 R

* cited by examiner

*Primary Examiner*—Edward K. Look
*Assistant Examiner*—Richard Woo
(74) *Attorney, Agent, or Firm*—Nixon & Vanderhye

(57) ABSTRACT

Coverplates are disposed to axially overlie end faces of the shanks of buckets and the dovetail connections of the buckets within turbine wheel slots. The coverplates have axially projecting angel wing seals. The coverplates also have balance weights on axial faces thereof opposite the angel wing seals to balance out any bending moments applied to the coverplate resulting from centrifugal forces when the turbine rotor is at speed. Thus, the centers of gravity of the coverplates are located close to or in the plane of the coverplates. A centering slot is provided along an inner face of each dovetail connection for the coverplates. Coverplate retention pins reside in wide sub-slots at the bases of the wheel slots. When the coverplates are secured against axial movement, the retention pins engage in the centering slots of the coverplate dovetails to prevent circumferential movement of the retention pins in the wide sub-slots.

15 Claims, 7 Drawing Sheets

NON-INTEGRAL BALANCED COVERPLATE AND COVERPLATE CENTERING SLOT FOR A TURBINE

BACKGROUND OF THE INVENTION

The present invention relates to coverplates axially overlying root portions of turbine buckets and mounting angel wing seals. The invention particularly relates to coverplates having balance weights to minimize stresses under centrifugal loading and centering slots to control the circumferential position of coverplate and bucket axial retention pins.

BRIEF SUMMARY OF THE INVENTION

Coverplates are generally used along the admission and discharge faces of turbine buckets adjacent their connection with the turbine wheel and support seals, generally referred to as angel wings, about the turbine rotor. The coverplates may be integrally cast with the bucket or may comprise non-integral separate parts mechanically assembled along axial faces of the bucket root and the wheel dovetail. In the design of an advanced gas turbine, it has been found necessary to lower the natural frequency of the buckets of in at least one of the turbine wheels to improve frequency margins. To accomplish that objective, non-integral coverplates and non-contoured bucket shanks are used to increase shank flexibility. While non-integral coverplates have been used in the past, the new advanced gas turbine imposes certain additional requirements on coverplate design.

Particularly, axial expansion and clearance requirements of the turbine require the angel wing seals for the coverplates on at least one of the turbine wheels to extend axially a greater distance than angel wing seals in prior coverplate designs employing non-integral coverplates. Because the angel wings extend axially from the outer axial faces of the coverplates, significant bending moments may be developed in the coverplates in response to centrifugal forces on the coverplates at rotor speed. The stresses caused by these bending moments may be increased to unacceptable levels and the coverplates may deflect toward the buckets, creating a large force on the buckets. Further, the interaction between the coverplates and buckets resulting from these stresses can stiffen the bucket shanks and reduce the effectiveness of the design with respect to lowering bucket natural frequencies. Consequently, there is a need for a coverplate design which controls the coverplate bending moment and deflections.

Additionally, the turbine wheel of the new advanced gas turbine has wide dovetail slot bottoms for stress reduction purposes. Wheel slot dovetails used previously in association with non-integral coverplate designs have typically utilized a narrow slot bottom. In prior non-integral coverplate designs, a twist lock cylindrical retainer pin is form-fit in the narrow bottom of the wheel slot. However, with the wider bottom slot configuration, there is a potential for circumferential movement of the retainer pin within the bottom slot which, if unconstrained, could cause the pin to rotate to a position where the bucket and coverplate are not constrained axially relative to the wheel. Thus, there is an additional need for limiting any circumferential motion of the twist lock retention pin.

In accordance with a preferred embodiment of the present invention, non-integral coverplates are provided for axially overlying root portions, i.e., the shanks and dovetail connections between the buckets and the wheel slots. Each coverplate, however, is provided with balancing weights, e.g., ribs, to control bending moments at rotor speed. Particularly, the balance ribs are located on an axial side of each coverplate opposite the side mounting the angel wing seals. The balance ribs of each cover plate project axially, straddle the shank of the bucket and cause the axial center of gravity of the coverplate to be located along the coverplate and a radial line of symmetry of the coverplate. The balance ribs also stiffen the coverplates, which further maintains control of the deflection of the coverplates relative to the buckets at speed.

In an additional preferred aspect of the present invention, the twist lock retainer pin retaining each coverplate in axial overlying relation to the bucket dovetail and shank is maintained centered against circumferential movement in the wide bottom wheel slot by the coverplate. The wide bottom slot, i.e., the non-form-fitting wheel dovetail wide sub-slot provided to reduce stresses does not provide adequate circumferential constraint of the twist lock pin. In conventional arrangements of the twist lock pin, the cylindrical pin is mounted in a form-fitting base of the wheel slot and is captured by the form-fit against circumferential movement. However, in the wide bottom slot arrangement, i.e., a wide sub-slot, the potential for circumferential movement of the pin exists. To preclude circumferential movement, the base of the dovetail of the coverplate has a flat and a centering slot in the flat for limiting the circumferential motion of the twist lock pin. The twist lock pin has half-heads at opposite ends to retain the pin against axial movement in the slot. The centering slot on the coverplate is engaged by the pin, particularly during turbine operation wherein centrifugal forces cause the pin to seat in the apex of the centering slot, constraining the pin from circumferential movement.

In a preferred embodiment according to the present invention, there is provided a coverplate axially overlying portions of a turbine bucket secured to a turbine wheel, comprising a coverplate body having a plurality of bosses and grooves along one end of the body for securing the coverplate in a generally complementary-shaped slot in the turbine wheel, an arcuate flange projecting from an end face of the coverplate body at a location radially outwardly of the body end and in a generally axial direction for forming a seal with flanges of adjacent coverplates about the turbine wheel, at least one balance weight projecting from an opposite end face of the coverplate body and in a generally opposite axial direction from the flange to provide a counterbalance to the flange when the coverplate body is subjected to centrifugal forces upon rotation of the turbine wheel.

In a further preferred embodiment according to the present invention, there is provided in a turbine having a turbine wheel rotatable about an axis and having a plurality of circumferentially spaced slots receiving generally complementary-shaped end portions of turbine buckets, the buckets including shanks intermediate the end portions, a platform, and turbine blades, a circumferential array of coverplates axially overlying shanks and the end portions of the buckets, each coverplate having an end portion thereof generally complementary in shape to the slot for reception in the slot, an arcuate flange projecting from one end face of each coverplate at a location radially outwardly of the coverplate end portion and in a generally axial direction for forming a seal with adjacent coverplates, an opposite end portion of each coverplate engaging the platform to retain the opposite end portion against axial movement relative to the bucket and at least one balance weight projecting from an opposite end face of each coverplate and in a generally opposite axial direction from the flange to provide a counterbalance to the flange when the coverplate is subjected to centrifugal forces upon rotation of the turbine wheel.

In a still further preferred embodiment according to the present invention, there is provided in a turbine wheel rotatable about an axis and having a plurality of circumferentially spaced slots receiving generally complementary-shaped end portions of turbine buckets, a circumferential array of coverplates axially overlying end portions of the buckets received in the slots and one axial face of the wheel, the coverplates having end portions thereof generally complementary in shape to the slots for reception in the slots, each coverplate having an arcuate flange projecting from one end face thereof at a location radially outwardly of the coverplate end portion and in a generally axial direction away from the wheel for forming a seal with flanges of adjacent coverplates, the end portion of each coverplate having a centering slot along a radial inner end thereof, a pin disposed in the radial innermost end portion of each slot and having an enlarged head portion at least at one end thereof for axially overlying the coverplate end portion, the radially innermost end of each slot having a larger diameter than the diameter of the pin in the slot, the pin engaging in the wheel slot and the centering slot to maintain the pin in a circumferentially centered position within the wheel slot.

DETAILED DESCRIPTION OF THE INVENTION

Figure 1:
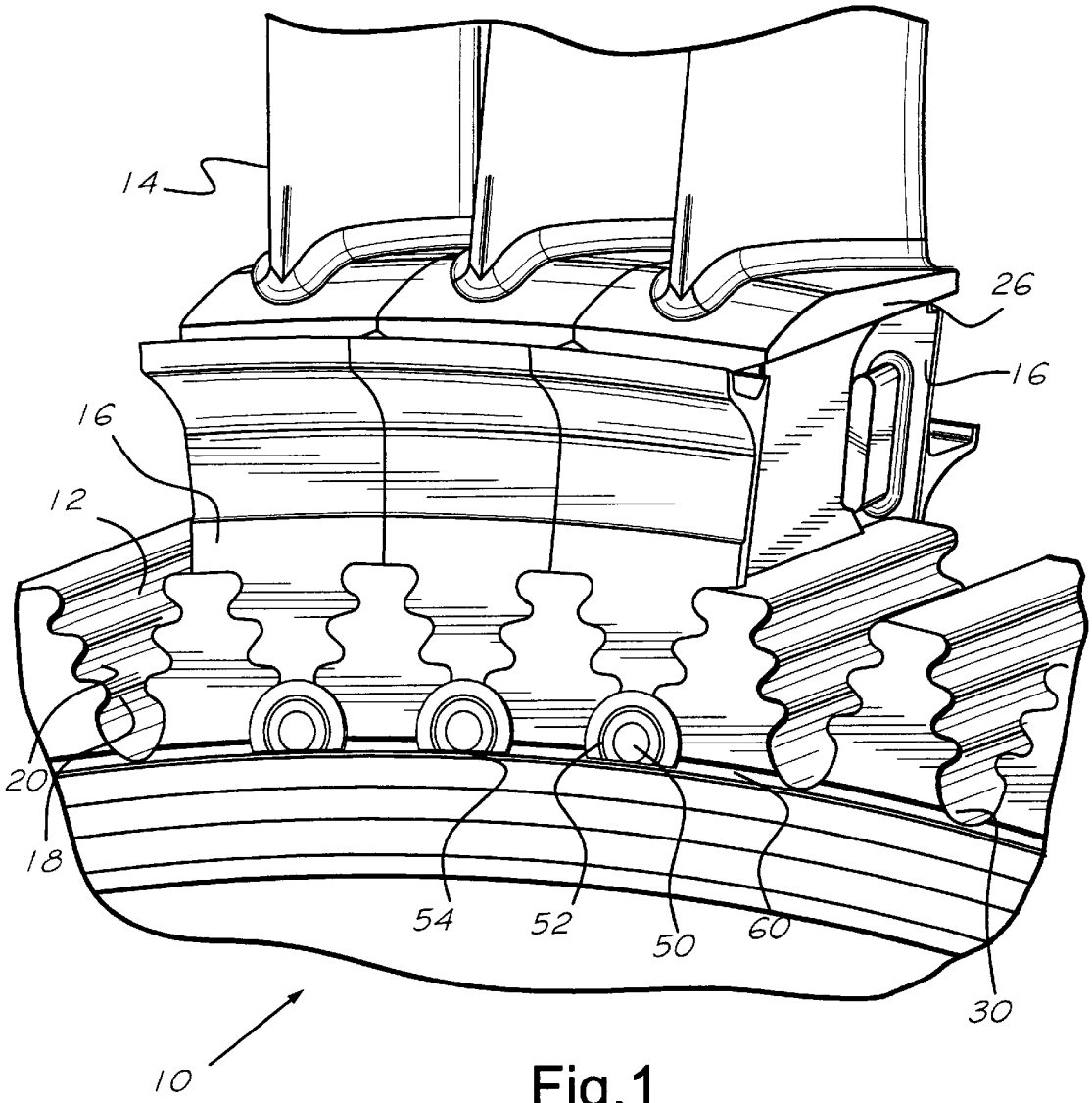
FIG. 1 is a fragmentary perspective view of the rim of a turbine wheel illustrating an assembly of turbine buckets, coverplates and wheel slots in accordance with a preferred embodiment of the present invention.
Figure 2:
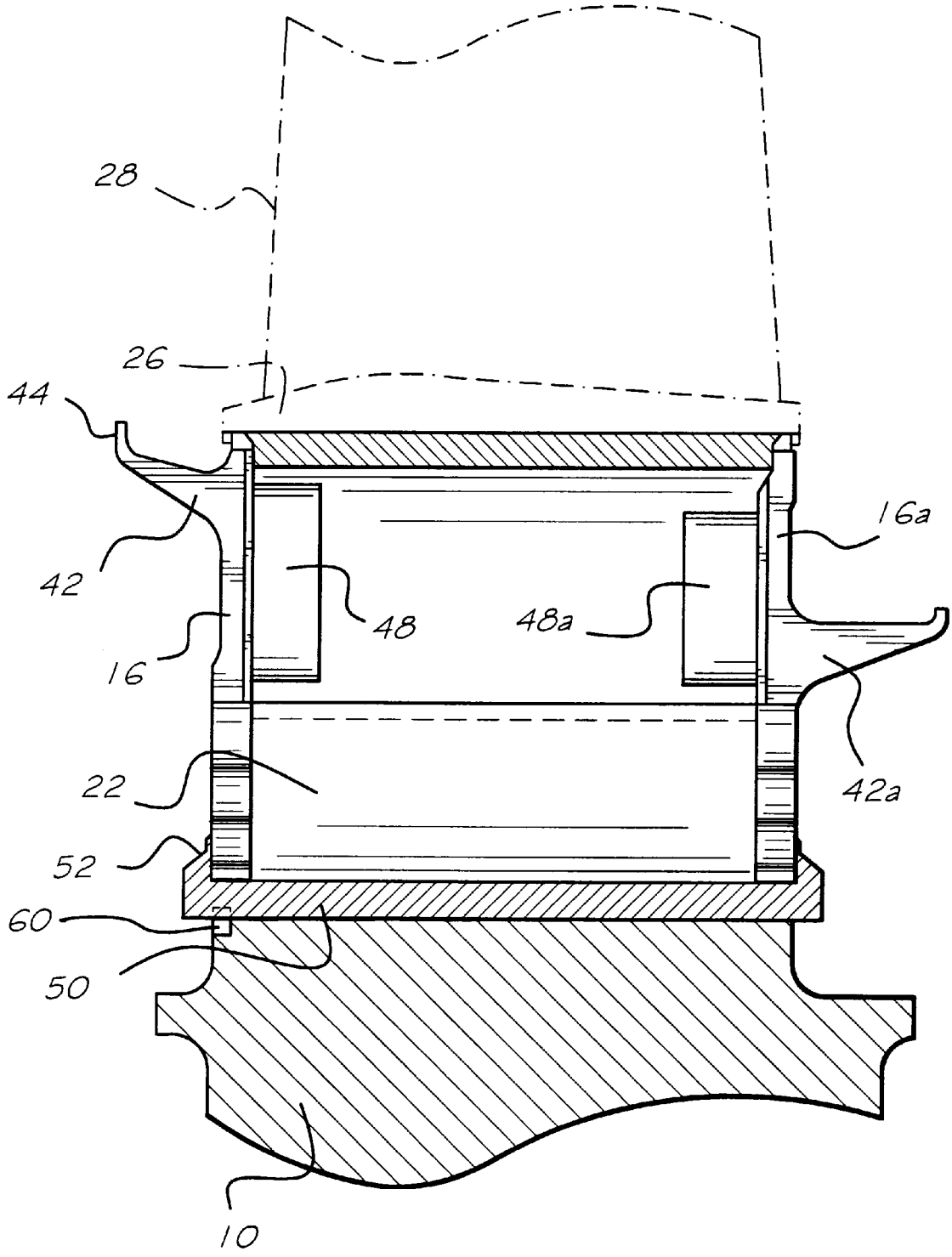
FIG. 2 is a cross-sectional view thereof taken in a circumferential direction.

Referring now to the drawings, particularly to FIG. 1, there is illustrated a turbine wheel 10 having a plurality of circumferentially spaced slots 12 for receiving generally complementary-shaped projections on the inner ends of the turbine buckets 14 and coverplates 16 therefor. The slots 12, as illustrated, have circumferentially extending bosses and grooves 18 and 20, respectively, and are sometimes referred to as dovetail or pine tree-configured slots. It will be appreciated that an array of buckets and covers are provided about the turbine wheel 10 at circumferentially spaced positions and are secured to the wheel 10 for rotation therewith about the axis of the rotor. As illustrated, each bucket 14 includes an inner end portion 22 (FIG. 3) generally complementary in shape to the shape of the slots 12, in the illustrated instance having a pine tree shape, a shank 24, a platform 26 and a vane 28. The buckets 14 are of the axial entry type whereby the bucket dovetail 22 is received in an axial direction in the wheel slot 12. From a review of FIG. 3, it will be appreciated that the shank 24 is of reduced thickness in order to lower the bucket natural frequency. It will also be appreciated that the buckets form a circumferential array thereof about the rim of the wheel 10 with the platforms 26 lying contiguous to one another.

Figure 3:
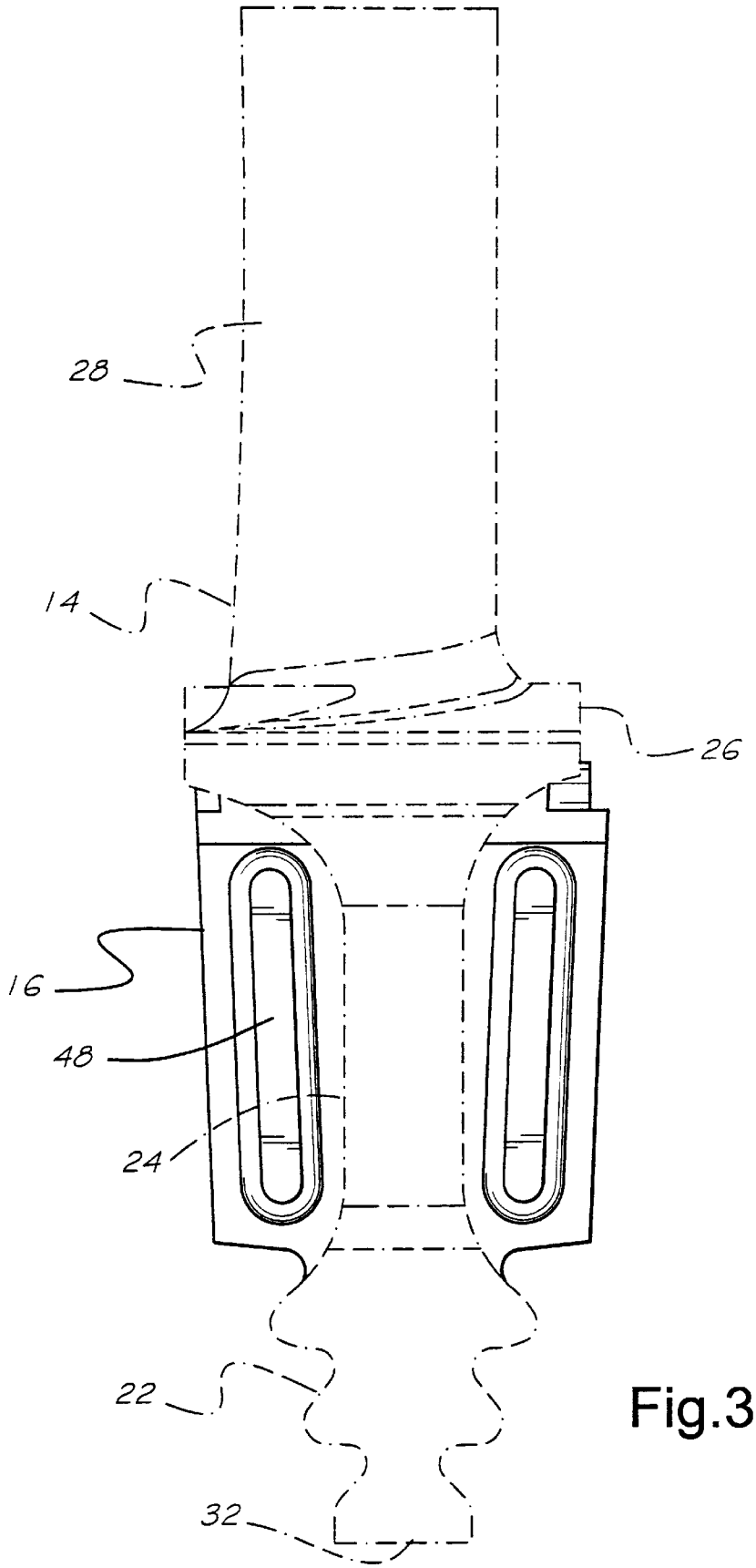
FIG. 3 is an axial cross-sectional view illustrating the inner end of the bucket, including the shank and dovetail, with a coverplate applied over the axial end face of the shank and bucket dovetail.

It will be appreciated from a review of FIG. 1 that the slot 12 is of a wide slot configuration. That is, the base of the slot 12 includes a sub-slot 30 which is wider in a circumferential direction than a conventional slot base. This wider configuration is used to reduce stresses. It will also be appreciated that the dovetails 22 of the buckets 14 extend only partially into the sub-slots 30 and have flat, radially inner end faces 32 (FIG. 3). From a review of FIG. 1, it will be appreciated that the coverplates 16 overlie axial end faces of the bucket dovetail and shank along axially opposite sides of the turbine wheel.

Figure 4:
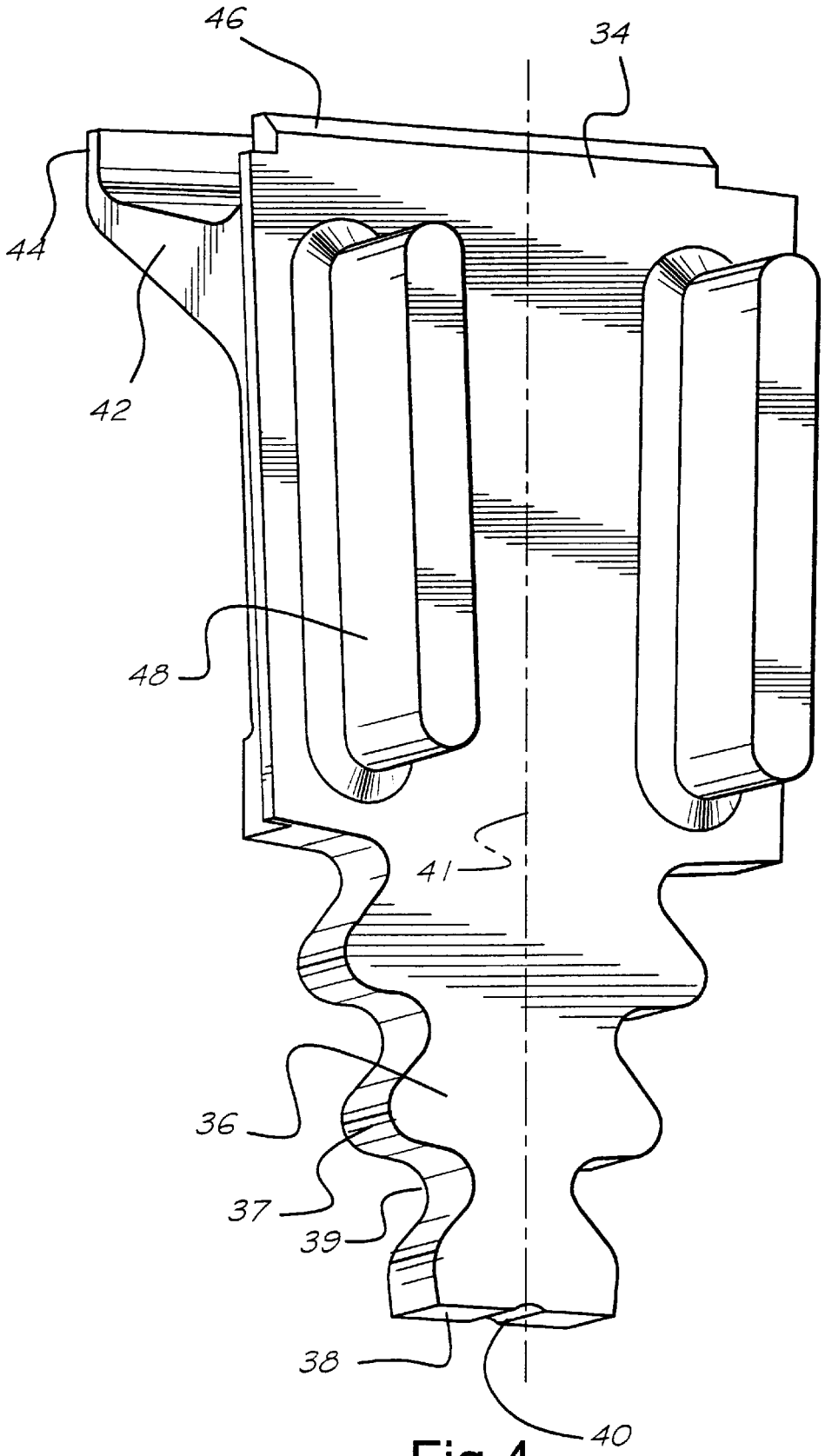
FIG. 4 is a perspective view of a non-integral coverplate hereof.

Referring particularly to FIG. 4, each of the coverplates 16 includes a coverplate body 34 essentially lying in a radial plane about the wheel. Body 34 has an inner end portion 36 for reception in the slot 12. More particularly, the inner end portion 36 is generally complementary in shape, i.e., dovetail-shape, to the shape of slot 12, i.e., portion 36 has bosses 37 and grooves 39. Similarly as the inner end of the dovetail 22 of buckets 14, the radially inner end face of the dovetail 36 of coverplate 16 has a flat 38. It also has a centering slot 40 for reasons described hereinafter. It will be appreciated that the coverplate is substantially symmetrical about a radial line of symmetry 41 through the coverplate body and which line of symmetry extends through the centering slot 40.

The coverplate 16 also includes an axially projecting arcuate seal 42 terminating in a radially outwardly directed flange 44. The seal and flange are commonly referred to as angel wings. From a review of FIG. 1, it will be appreciated that the angel wings on the array of coverplates secured to the wheel form a continuous circumferentially extending seal around the wheel for sealing with an adjacent spacer of the turbine. The radial outer end of the coverplate 16 also includes a circumferentially extending flange 46 for reception in a groove opening radially inwardly along the radial inner face of the platform 26.

To balance each coverplate 16, at least one and preferably a pair of balance weights, e.g., ribs 48, are formed on the axially opposite side of the coverplate from the angel wing seals. The balance ribs 48 comprise axial projections elongated in a radial direction and, as illustrated in FIG. 3, straddle the shank 24 of the associate bucket 14 when the coverplate is secured to the turbine wheel. The coverplates on the forward and aft sides of the wheel are similar to one another, with two exceptions. First, the aft coverplate **16*a* has its axially projecting angel wing seal 42*a* located at a radially inner position relative to the position of angel wing seals 42 on the forward coverplate 16. Additionally, the balancing ribs 48*a* on the aft coverplate 16*a* are smaller in radial extent but larger in cross-section. In this preferred embodiment, the mass of the aft balance ribs is slightly greater than the mass of the forward balance ribs to offset the longer aft angel wing. In both forward and aft coverplates, the ribs 48 and 48*a* lie approximately along radii of the wheel and are symmetrical about the line of symmetry 41** through the dovetail center of each coverplate, respectively.

A retention pin 50 is employed to retain the forward and aft coverplates and bucket within the wheel slot 12. Pin 50 is cylindrical in cross-section throughout its length. Opposite ends of pin 50 each have a radially outwardly projecting head or flange 52 on the pin 50 which extends slightly in excess of 180° but forms a flat 54 along one edge, corresponding to a cylindrical surface of the pin 50. The pin 50 resides in the sub-slot 30 and the flange 52 overlie the outer surfaces of the forward and aft dovetails of the coverplates and opposite wheel faces to retain the coverplates against axial displacement relative to the wheel.

Figure 5:
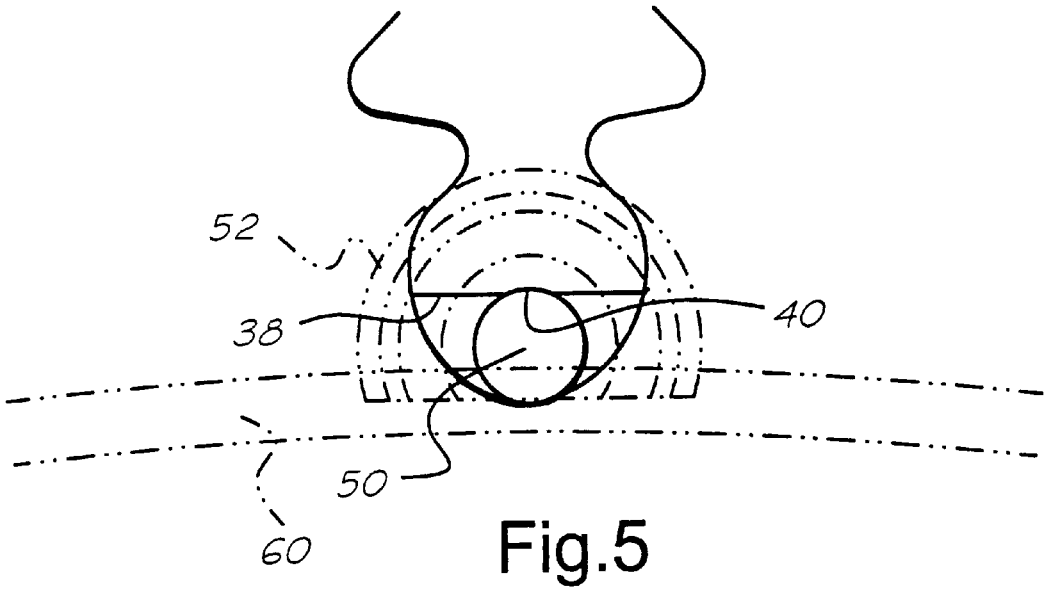
FIG. 5 is a fragmentary cross-sectional view illustrating the retention pin in the centering slot of the coverplate with the pin securing the coverplate and bucket in the wheel slot.
Figure 6:
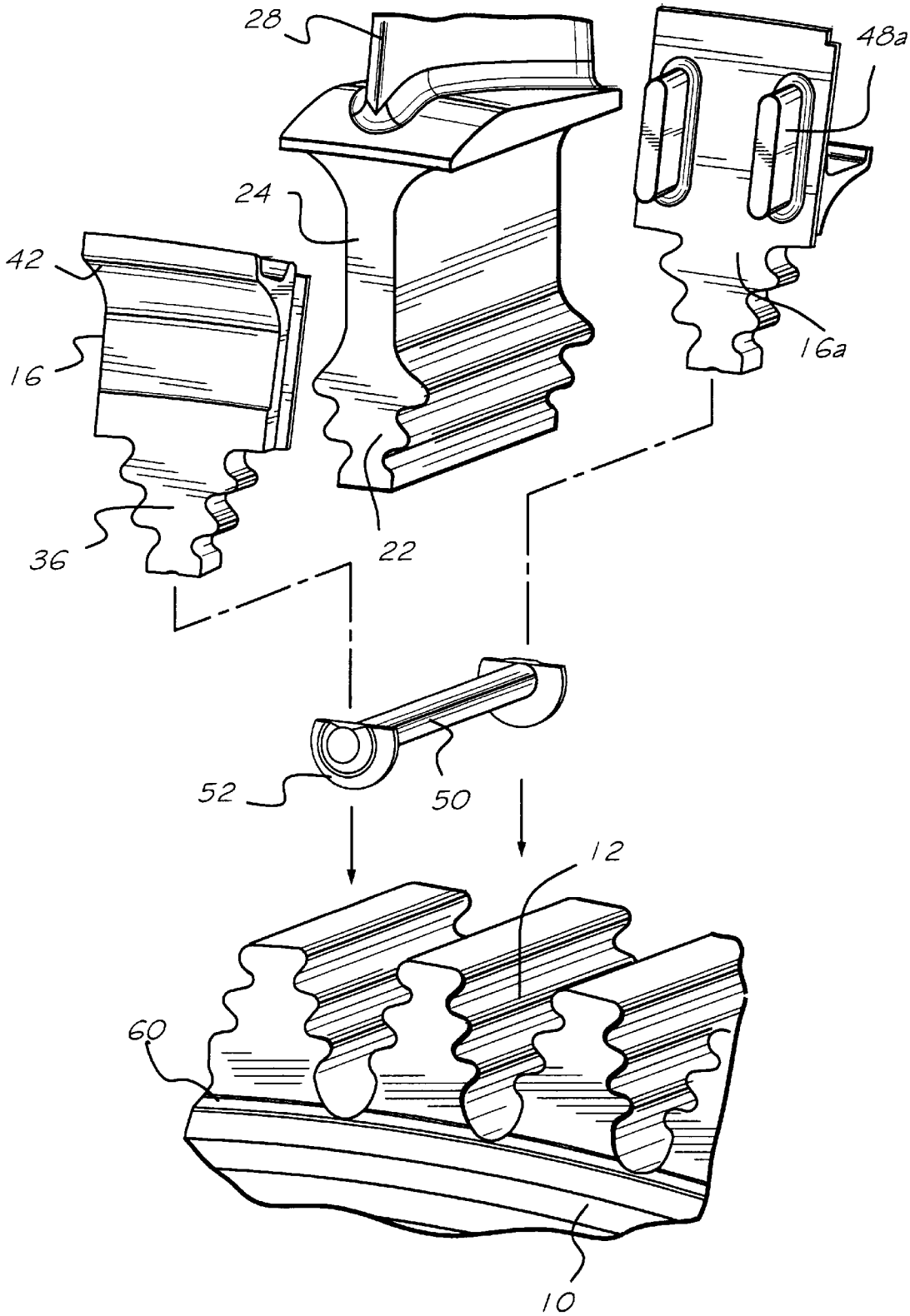
FIGS. 6 and 7 are fragmentary perspective views of a manner of assembling the retention pin, bucket and coverplates to the wheel.
Figure 7:
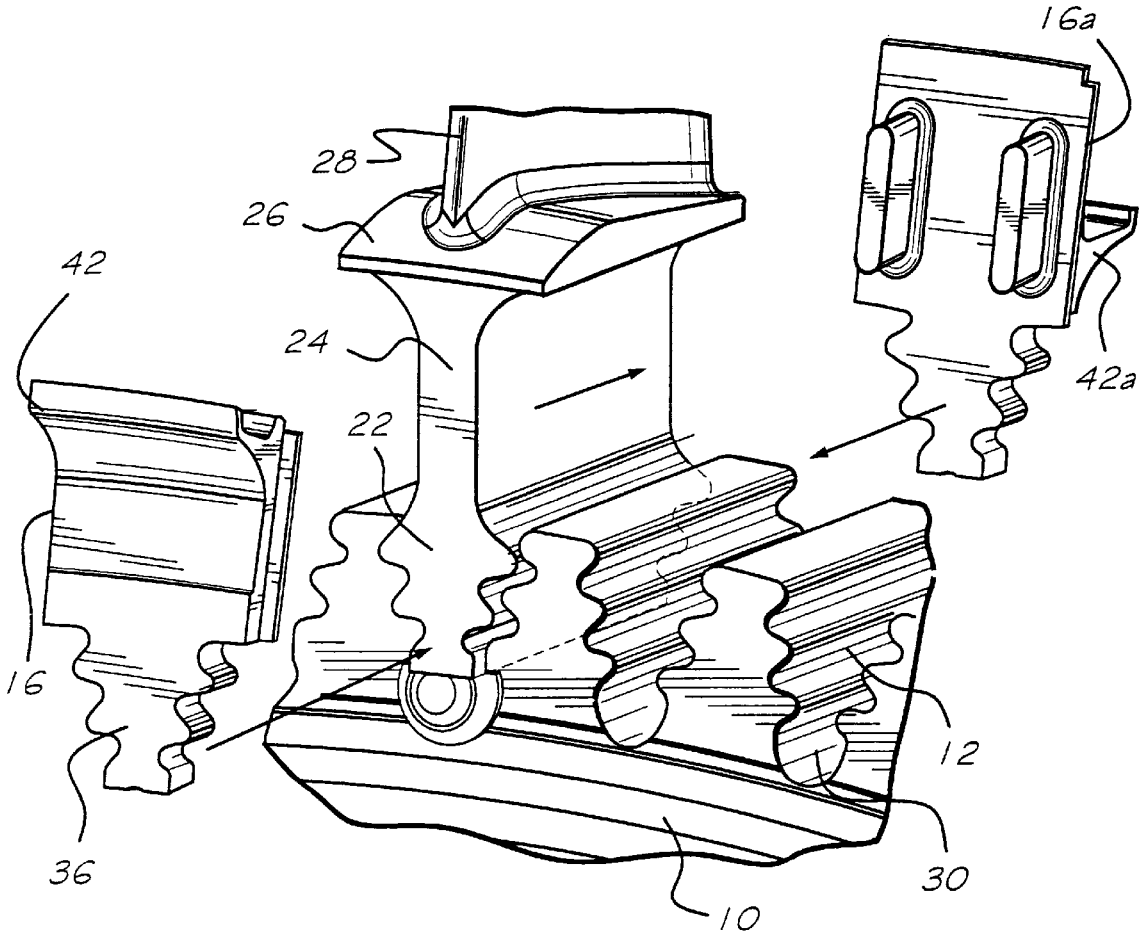

To install a bucket and coverplates on the wheel 10, the pin 50 is first disposed in the wide sub-slot 30 with the flat end edges 54 of head 52 facing radially outwardly as illustrated in FIG. 6 followed by the axially entering dovetail of a bucket. Because the dovetail of the bucket terminates in a radially inner flat end face 32, the bucket dovetail 22 is received axially within the slot 12 with the bosses and grooves of the slot 12 engaging the complementary grooves and bosses, respectively, of the bucket dovetail. The flat end face 32 thus radially overlies the cylindrical surface of the pin 50. A coverplate 16 is then applied to axially overlie the end face of the bucket dovetail and shank as illustrated in FIG. 7. To apply the coverplate, the flange 46 of the coverplate is inserted into the groove below the platform 26. The dovetail 22 is also inserted into the dovetail at the end of the slot 12. The flat 38 at the radial inner end face of the dovetail 36 and the centering groove 40 overlie the cylindrical pin 50. The opposite coverplate is likewise applied to the opposite axial face of the wheel. When both coverplates are applied, the pin 50 is rotated into the position illustrated in FIGS. 1 and 5 such that the enlarged heads 52 of pin 50 engage the outer faces of the coverplates and the wheel. A staking groove 60 is also formed along one of the wheel faces and the margins of the head along that face is staked into the staking groove to preclude rotation of the pin 50.

From a review of FIG. 5, it will be appreciated that there is a potential for circumferential displacement of the pin 50 in the wide sub-slot 30. To preclude this displacement, the centering slot 40 receives a circumferential portion of the pin. Thus, the potential for circumferential movement of the twist lock pin 50 in the wide sub-slot 30 is eliminated. Also, during turbine operation, centrifugal forces cause the pin to seat at the apex of the centering slot, further constraining any potential for circumferential movement.

It will be appreciated that with the foregoing construction, the balancing ribs 48 and 48*a* on the coverplates 16 and 16*a*, respectively, substantially eliminate bending moments applied to the coverplates as a result of centrifugal forces acting on the coverplates when the turbine is at speed. That is, the center of gravity of each coverplate is shifted axially by providing the balancing ribs such that the center of gravity preferably lies within or close to the plane of the coverplate. Consequently, the bending forces of the angel wings are substantially balanced out by the balance ribs. Also, the balancing ribs are symmetrically located on opposite sides of the line of symmetry and the long axes of the balancing ribs lie approximately along radii of the wheel. The symmetry in a radial direction is maintained.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A coverplate axially overlying portions of a turbine bucket secured to a turbine wheel, comprising:

a coverplate body having a plurality of bosses and grooves along one end of the body for securing the coverplate in a generally complementary-shaped slot in the turbine wheel;

an arcuate flange projecting from an end face of said coverplate body at a location radially outwardly of said body end and in a generally axial direction for forming a seal with flanges of adjacent coverplates about the turbine wheel;

at least one balance weight projecting from an opposite end face of said coverplate body and in a generally opposite axial direction from said flange to provide a counterbalance to said flange when the coverplate body is subjected to centrifugal forces upon rotation of the turbine wheel.

2. A coverplate according to claim 1 wherein said coverplate body includes a line of symmetry between opposite sides thereof, a second balance weight projecting from said opposite end face of said coverplate body, said balance weights lying on opposite sides of the line of symmetry.

3. A coverplate according to claim 1 wherein said one body end includes a centering slot at a distal end thereof.

4. A coverplate according to claim 1 wherein said coverplate body includes a line of symmetry between opposite sides thereof, a second balance weight projecting from said opposite end face of said coverplate body, said balance weights lying on opposite sides of the line of symmetry, each said balance weight comprising a rib elongated in a radial direction, said ribs being spaced from one another in a circumferential direction.

5. In a turbine having a turbine wheel rotatable about an axis and having a plurality of circumferentially spaced slots receiving generally complementary-shaped end portions of turbine buckets, said buckets including shanks intermediate said end portions, a platform, and turbine blades, a circumferential array of coverplates axially overlying shanks and said end portions of said buckets, each said coverplate having an end portion thereof generally complementary in shape to said slot for reception in said slot, an arcuate flange projecting from one end face of each said coverplate at a location radially outwardly of said coverplate end portion and in a generally axial direction for forming a seal with adjacent coverplates, an opposite end portion of each said coverplate engaging said platform to retain said opposite end portion against axial movement relative to the bucket and at least one balance weight projecting from an opposite end face of each said coverplate and in a generally opposite axial direction from said flange to provide a counterbalance to the flange when the coverplate is subjected to centrifugal forces upon rotation of the turbine wheel.

6. Apparatus according to claim 5 wherein each said coverplate includes a radially extending line of symmetry and a second balance weight projecting from said opposite end face of said coverplate, said balance weights lying on opposite sides of said line of symmetry and straddling the shank of said associated bucket.

7. Apparatus according to claim 5 wherein said end portion of said coverplate has a centering slot at a distal end thereof, a pin disposed in the wheel slot at the radially innermost end thereof and having an enlarged head at one end for axially overlying said coverplate end portion.

8. Apparatus according to claim 7 wherein the radially innermost end of the slot has a larger diameter than the diameter of the pin, said pin engaging in said balance wheel large diameter slot and engaging said centering slot to maintain said pin in a circumferentially centered position within said slot.

9. Apparatus according to claim 5 wherein said end portions of said buckets and said coverplates are generally pine tree-shaped for reception in generally complementary pine tree-shaped slots of said wheel.

10. Apparatus according to claim 5 wherein each said coverplate includes a second balance weight projecting from said opposite end face of said coverplate, said balance weights being spaced from one another in a circumferential direction.

11. Apparatus according to claim 5 wherein each said coverplate includes a radially extending line of symmetry and a second balance weight projecting from said opposite end face of said coverplate, said balance weights lying on opposite sides of said line of symmetry and straddling the shank of said associated bucket, each said balance weight comprising a rib elongated in a generally radial direction, said ribs being spaced from one another in a circumferential direction.

12. Apparatus according to claim 5 wherein said coverplates are circumferentially arranged on axially opposite faces of the turbine wheel, the arcuate flanges along the array of coverplates along one face of the wheel being radially offset from the arcuate flanges along the array of coverplates along another face of said wheel, the center of gravity of the balance weights of the coverplates on opposite faces of the wheel being located at radially offset locations relative to one another.

13. Apparatus according to claim 12 wherein each said coverplate includes a radially extending line of symmetry and a second balance weight projecting from said opposite end face of said coverplate, said balance weights lying on opposite sides of said line of symmetry and straddling the shank of said associated bucket.

14. In a turbine wheel rotatable about an axis and having a plurality of circumferentially spaced slots receiving generally complementary-shaped end portions of turbine buckets, a circumferential array of coverplates axially overlying end portions of said buckets received in said slots and one axial face of said wheel, said coverplates having end portions thereof generally complementary in shape to said slots for reception in said slots, each said coverplate having an arcuate flange projecting from one end face thereof at a location radially outwardly of said coverplate end portion and in a generally axial direction away from said wheel for forming a seal with flanges of adjacent coverplates;

said end portion of each said coverplate having a centering slot along a radial inner end thereof, a pin disposed in the radial innermost end portion of each slot and having an enlarged head portion at least at one end thereof for axially overlying the coverplate end portion, said radially innermost end of each said slot having a larger diameter than the diameter of the pin in said slot, said pin engaging in said wheel slot and said centering slot to maintain said pin in a circumferentially centered position within said wheel slot.

15. Apparatus according to claim 14 including balancing weights on opposite sides of said coverplates from said flanges to counterbalance the flanges when the coverplates are subjected to centrifugal forces upon rotation of the turbine wheel.

* * * * *